US005279471A

United States Patent [19]

Peters

[11] Patent Number: 5,279,471

[45] Date of Patent: Jan. 18, 1994

[54] DEVICE FOR SPLICING WEB MATERIALS

[76] Inventor: Manfred Peters, Sjögräsvägen 15, Kungsbacka, Sweden, S-434 94

[21] Appl. No.: 835,988

[22] PCT Filed: Sep. 3, 1990

[86] PCT No.: PCT/SE90/00559

§ 371 Date: Feb. 21, 1992

§ 102(e) Date: Feb. 21, 1992

[87] PCT Pub. No.: WO91/03416

PCT Pub. Date: Mar. 21, 1991

[30] Foreign Application Priority Data

Sep. 1, 1989 [SE] Sweden ..... 8902896

[51] Int. Cl.[5] ..... B65H 19/18

[52] U.S. Cl. ..... 242/58.3; 242/58.6; 242/66

[58] Field of Search ..... 242/58.1, 58.2, 58.3, 242/58.5, 58.6, 66, 68.7

[56] References Cited

U.S. PATENT DOCUMENTS

| | | | |
|---|---|---|---|
| 2,581,711 | 1/1952 | Roselius | 242/58.1 |
| 2,775,409 | 12/1956 | Pomper | 242/58.2 |
| 3,194,508 | 7/1965 | Netze | 242/58.2 |
| 3,886,030 | 5/1975 | Hurst | 242/58.3 |
| 4,443,291 | 4/1984 | Reed | 242/58.2 |
| 4,612,080 | 9/1986 | Aiuola et al. . | |
| 4,700,642 | 10/1987 | Hankinson, Jr. | 242/58.1 |
| 4,722,489 | 2/1988 | Wommer | 242/58.1 |
| 4,757,951 | 7/1988 | Ludszeweit | 242/58.1 |
| 4,816,111 | 3/1989 | Pittarello et al. . | |
| 4,881,695 | 11/1989 | Beisswanger | 242/58.6 |
| 5,083,718 | 1/1992 | Chen | 242/58.1 |
| 5,096,135 | 3/1992 | Ekhenberger et al. | 242/58.6 |

FOREIGN PATENT DOCUMENTS

| | | | |
|---|---|---|---|
| 1231994 | 1/1967 | Fed. Rep. of Germany . | |
| 4122411 | 1/1992 | German Democratic Rep. | 242/58.1 |
| 857224 | 12/1960 | United Kingdom | 242/58.1 |
| 2018727 | 10/1979 | United Kingdom | 242/58.1 |

*Primary Examiner*—Thomas B. Will

*Attorney, Agent, or Firm*—Merchant, Gould, Smith, Edell, Welter & Schmidt

[57] ABSTRACT

Device for splicing the trailing end or the cut off end of a first roll of web material with the starting end of a second roll of web material, the first and second roll having a winding core, whereby the web material pulled out from the first roll by a roller is transmittable to a starting end of the second roll of web material which is situated on a splicing table, where these are connected to each other, such that during rolling off web material from the first and second roll, and inside the web material of the first roll and near the nip between the first roll and a storage roll for this, the roller, which is pivotally hinged in a spring loaded arm is provided, such that the arm exerts a fit-up pressure on the web material of the first roll, whereby the breaking or the termination of the web material swings the roller in a direction off the first and second roll of web material whereby the end portion of the web is carried and transported to the splicing table provided between two stores for the first and second roll, the second store providing a unit for lifting and moving the second roll of web material to the first store.

6 Claims, 5 Drawing Sheets

DEVICE FOR SPLICING WEB MATERIALS

The present invention refers to a device for splicing the trailing end or the cut off end of a rolled up web material with the starting end of another roll of web material, whereby web material pulled out from a first roll of web by means of a roller is transmittable to a starting end of a second material roll web material which is situated on a splicing table, where these are connected to each other.

BACKGROUND OF THE INVENTION

Web materials, e.g. paper, plastic films, foils, fabric and so on, are in great extent used as semi-manufacture for further processing or use for example as packing material. The web material is delivered in rolls and normally is placed in a roll stand, from which the material is guided into a converting machine. The starting end of the web material has to be thread through various stations which is both time consuming and a tedious work, which moreover has to be repeated every time a new roll of web material is placed in the roll stand.

OBJECTS OF THE INVENTION AND MOST IMPORTANT FEATURES

The object of the invention is to provide a device which makes it possible to change a roll of material without breaking the web of material to the converting machine. Moreover the device must be simple to handle and inexpensive to procure and in maintenance. A change of rolls should also be possible to be carried out by unskilled personnel. These tasks have been solved by during rolling off web material from the roll of material, inside the web and near the nip between the material roll and a storage roll for this, said roller is provided, which is pivotally hinged in spring loaded arm or the like, provided to exert a fit-up pressure on the web material and at break of the web or termination of the web swing the roller in a direction off the material roll, whereby the end portion of the web material is carried and transported to the splicing table, that the splicing table is provided between two stores for each material roll, and that in the second store is provided a unit for lifting and moving of the second material roll to the first store.

SPECIFICATION OF THE DRAWINGS

The invention will be described below with reference to accompanying drawings which show an embodiment thereof.

SPECIFICATION OF AN EMBODIMENT

Figure 1:
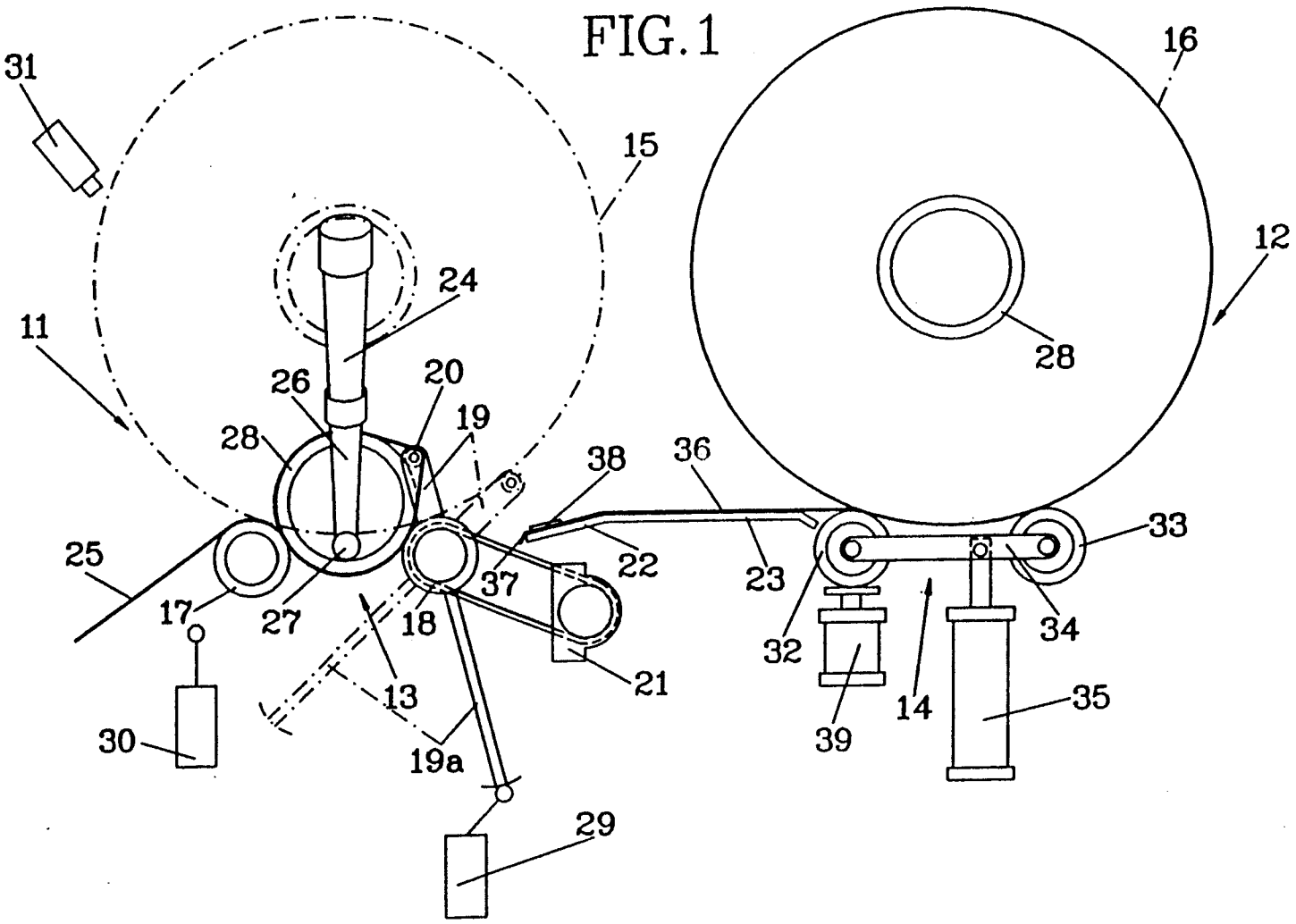
FIG. 1 shows diagrammatically an elevational view of a roll changing device according to the invention.
Figure 2:
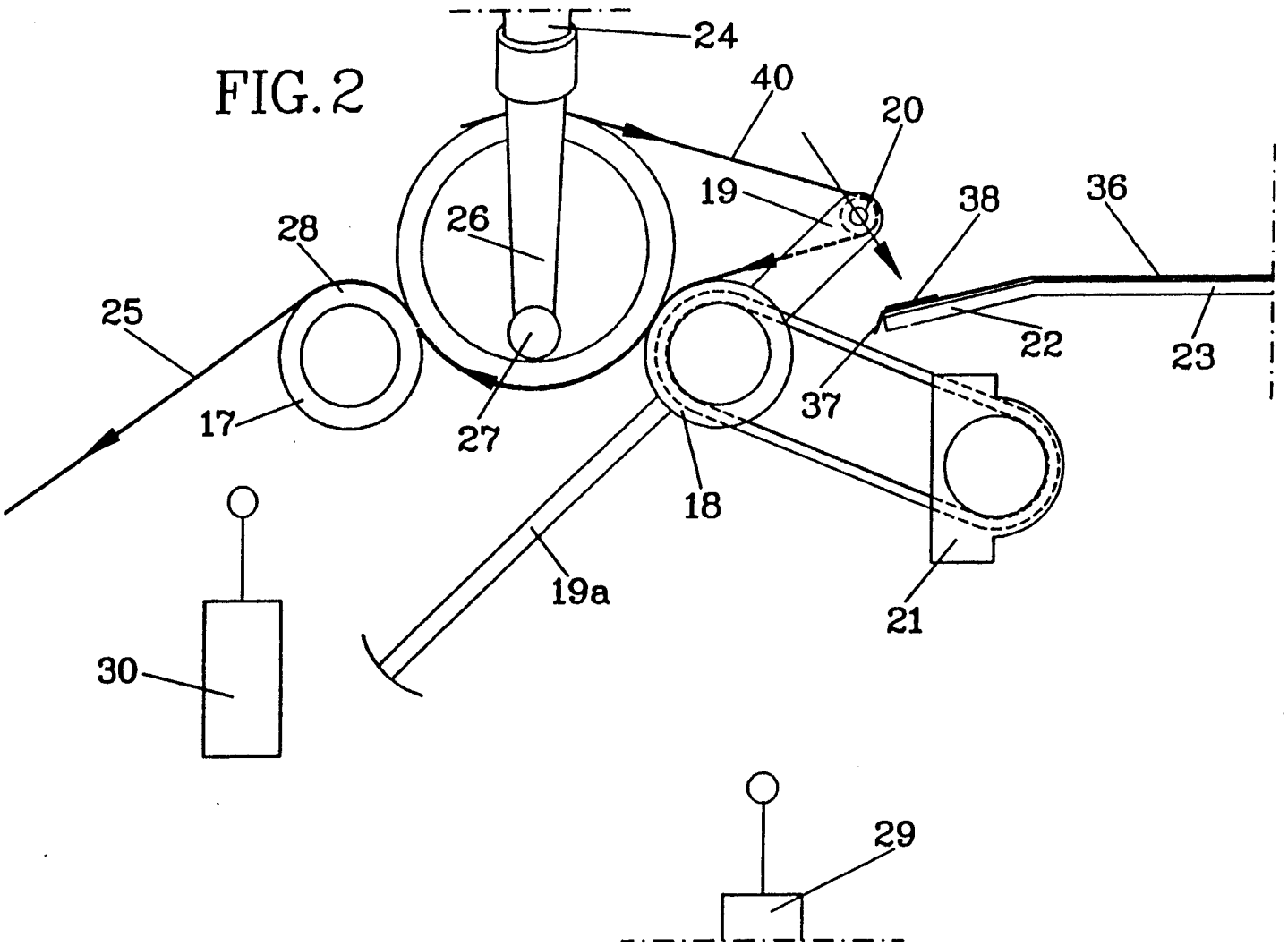
FIG. 2 shows a part of the device according to FIG. 1 during the splicing phase.
Figure 3:
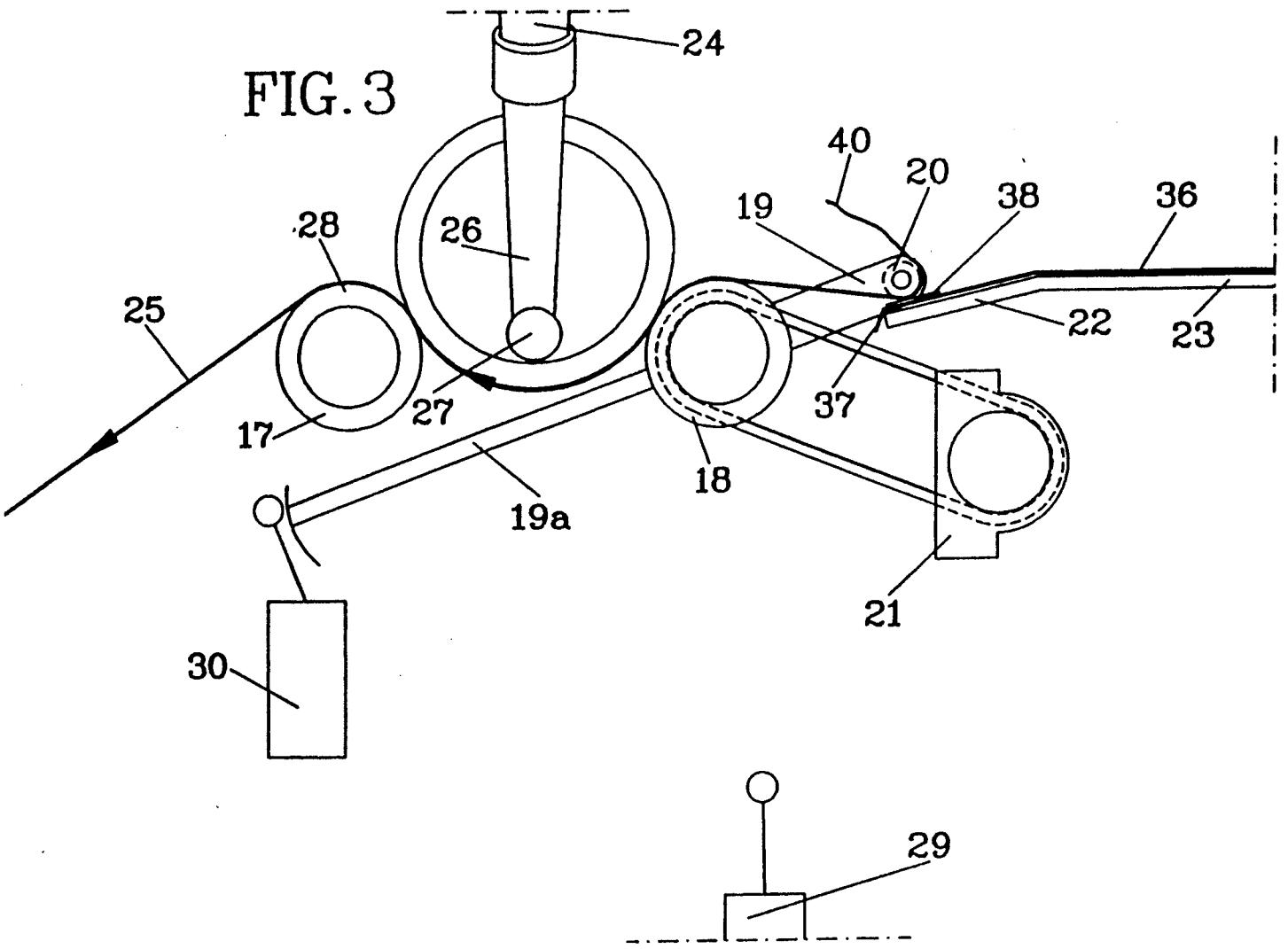
FIG. 3 is a view analogous to that of FIG. 2 after terminated splicing.
Figure 4:
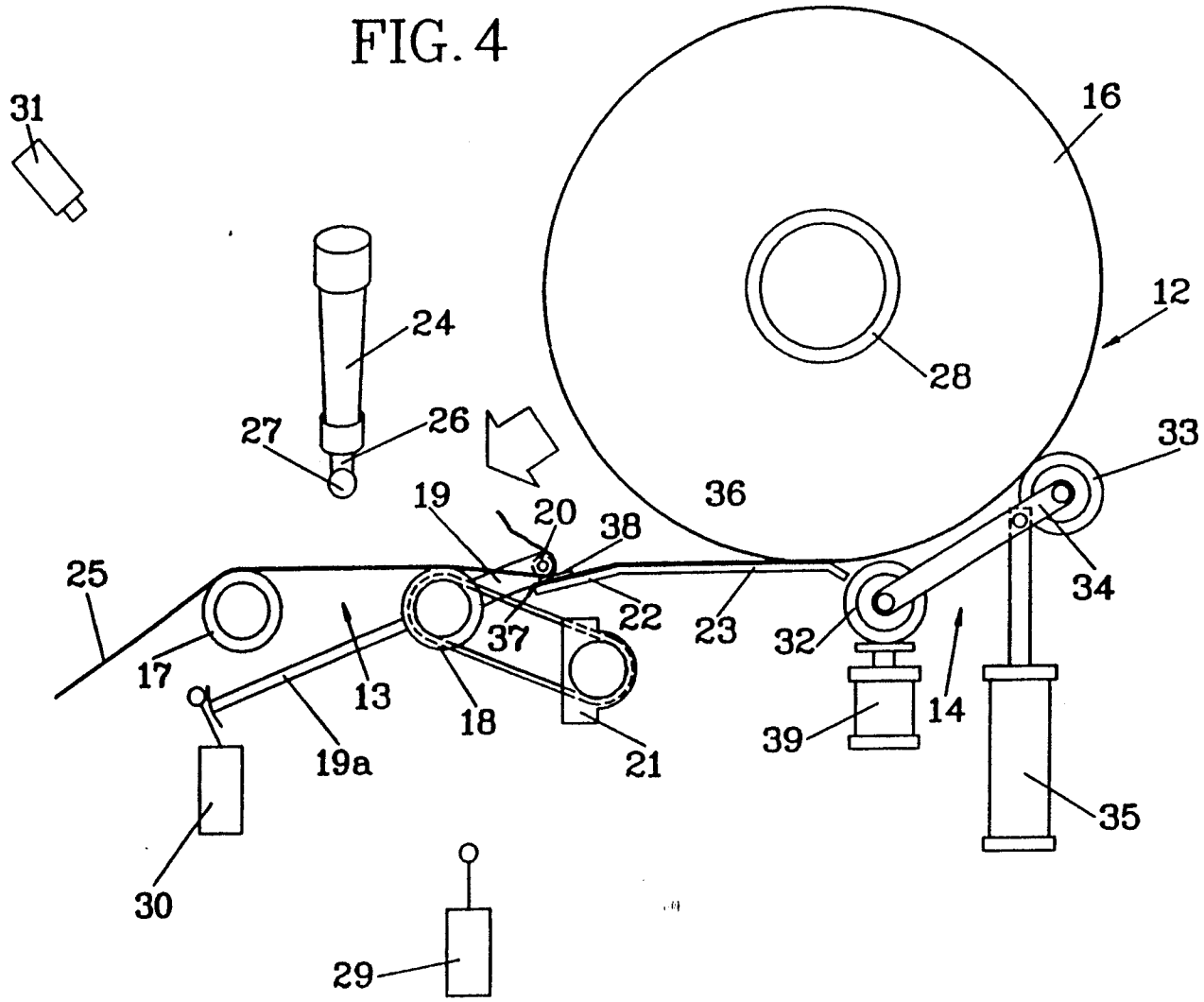
FIG. 4 shows a view analogous to that of FIG. 1 of the device during roll change in progress.

The device according to the invention comprises two roll stores 11 and 12, the one of which in the drawing the left roll store 11 is the permanent store of the device, while the right store 12 in the drawing is a temporary store. Both stores are provided on mainly the same height and both each comprise a store 13 and 14 respectively to each support a roll of material 15 and 16 respectively. The store 13 comprises two carrier rolls 17 and 18 arranged in parallel and separated from each other, of which the carrier roll 17 is a motor-driven feeding roll for uncoiling of web material winded on the roll 15, such as paper, film, foils, fabric etc. Concentrically on the shaft of the support roll 18 an arm 19 is mounted on bearings, which arm at its free end supports a roller 20, which is freely rotatably pivoted in the arm. This is spring loaded or operates under influence of a pivot cylinder, which seeks to turn the arm in a direction towards a splicing table 22, which forms a part of a transport path 23, which connects the ordinary roll store with the temporary roll store 12. In the roll store 11 a retainer apparatus 24 is included in the form of a pneumatic piston cylinder, which at the end of uncoiling of the web material 25 from the material roll 15 locks this versus uplifting from the store 13. The retainer apparatus 24 is somewhat inclined in relation to the vertical plane, such that a pulley 27 provided at the free end of the piston 26 can be inserted in the core of the material roll 15, which core is constituted by a sleeve 28.

Further the permanent roll store 11 is provided with limit switches 29 and 30, which are arranged to be activated by an extension 19a of the arm 19. The pulley 27 permits the roll 15 to rotate in the store 13, but is retained in its position between the support rolls 17 and 18 and thereby prevents a too early release of the trailing end of the web material. A photo electric cell 31 is provided to detect if a material roll 15 is present in the store 13 or not. In the temporary roll store 12 the supply 14 consists of likewise from each other spaced parallel support rolls 32 and 33, which are connected via a yoke 34. By means of an adjusting apparatus 35, which acts on the yoke 24 the support roll can be raised and lowered, so that this has a function of lifting roll. A material roll 16 situated in the supply 14 when the support roll 33 is lifted will roll the material roll over the support roll 32 and on the transport path 23 which possibly can incline slightly, so that the material roll 16 can roll over to the permanent roll store 11. When a new roll 16 is placed in the temporary roll store 12 an amount of its web material 36 is pulled out to such an extent, that the starting end of the web material 36 will be situated on the splicing table 22. On the side turned upwards of the starting end 37 of the web 36 a connection means is applied, which can be a double acting strip of tape 38. The second support roll 32 of the temporary roll store 11 store can be provided with a brake 39, to prevent idling of the roll in the store.

MODE OF ACTION OF THE INVENTION

From a material roll 15 which can be placed in the permanent roll store 11 such an extent of the web material 25 is uncoiled that the roller 20 will be situated inside the web material, that is between this and the material roll 15 and further between the support rolls 17 and 18 to a converting machine not shown. This first threading of the web is done manually with the material roll still lifted up, at heavy rolls of material when this is still hanging in the lifting tool (not shown). At a rate of the production of the converting machine, such a quantity is uncoiled of the web material that only a last layer remains, or alternatively if the web should break, the free trailing end or the break end 40 will cause a slacken in the web, such that the arm 19 under influence of a spring or pivot cylinder 21 swings in a direction to the splicing table 22. In this swinging movement the trailing end 40 will take part, which means that a portion of said trailing end will be pressed to fit-up against the double acting tape 38 which is applied at the starting end 37 of the web 36, which thus will be connected to the trailing end of the web material 25. After that this can be fed up to the converting machine without any time consuming threading having to be carried out.

At the end of the swinging movement of the arm 19, when the major part of the web 25 is decoiled from the material roll 15, the limit switch 29 is activated by the extension of the arm 19, which switch gives a signal to the retainer apparatus 24, which is activated and locks the roll of material 15 and its sleeve 28 respectively in the store 13. The holding of the roll of material 15 also prevents the web being released to early. When the arm has completed its swinging movement and the roller 20 has come to fit—up against the splicing table 22 the second limit switch 30 is activated, which gives a signal to the retainer apparatus 24 to inhibit the holding of the sleeve 28. This now can be removed, which is sensed by the photo cell 31, which gives an impulse to the brake 39, which prevents idling of the roll of material 16.

When the converting machine has a temporary stop in the production, a signal is given to the adjusting apparatus 35 which lifts the support roll 33 to such an extent, that the material roll 16 can roll via the transport path 23 to the permanent roll store 11. At this transfer the starting end 37 of the web 36 is again rolled up on the roll 16, whereby the roller 20 will be situated inside the web and in a new extension position in the same way as in the beginning of the uncoiling of the material roll 15. Thus the roller is situated in its stand by position between the roll and the web until a new slack occurs in this. The starting end of the web 36 thus is connected to the trailing end of the web 25 and can be fed up to the converting machine without any time consuming threading having to be carried out.

Figure 5:
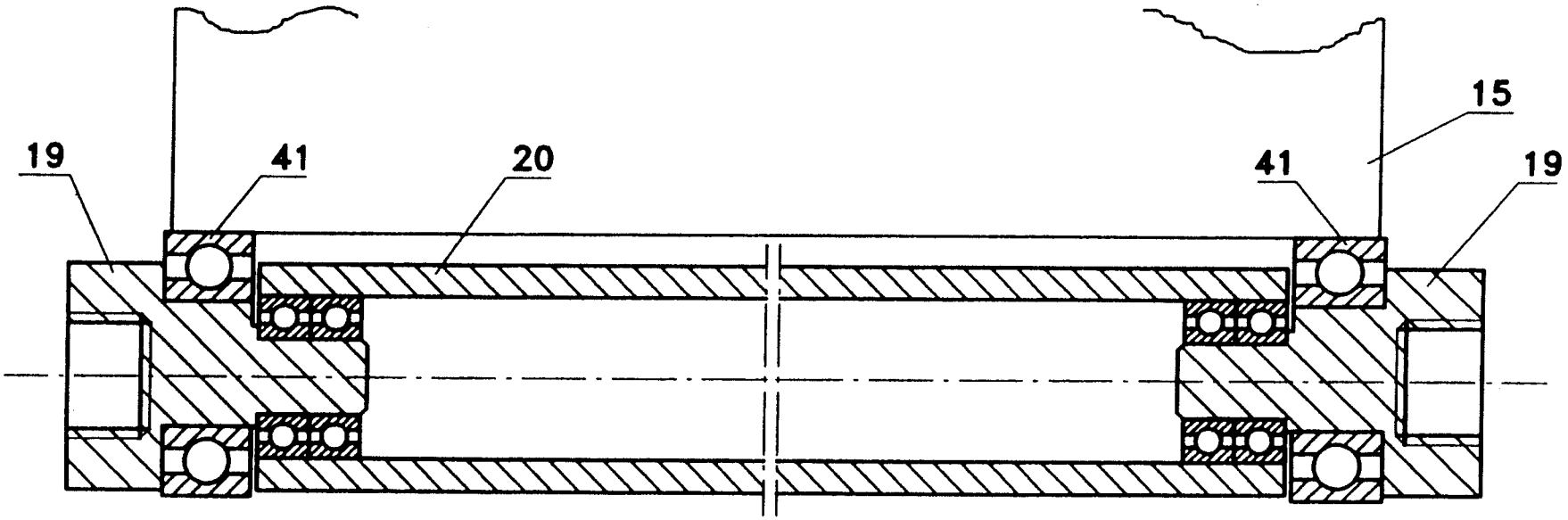
FIG. 5 shows a section through a roller in a device.

In order to prevent electrostatic charging at the uncoiling via the roller 20, this is at the ends provided with concentrically pivoted wheels (ball-bearings) 41, which are arranged in such a way and dimensioned such with respect to the roller 20, that this in its standby position does not come into fit-up against the material roll 15 and 16 but is slightly spaced from this, as is shown in FIG. 5. The eccentricity is chosen such, that the "back side" is aligned to the circumference of the wheels 41, so that the web is provided with a smooth fit-up surface.

The invention is not limited to the embodiment shown but several variations are conceivable within the scope of the patent claims. Thus the material roll can be pivoted on a central shaft instead of said store and the roller 20 could be located in an other suitable position along the web.

I claim:

1. Device for splicing a trailing end or a cut off end of a first roll of web material with a starting end of a second roll of web material, whereby the web material pulled out from the first roll by means of a roller is transmittable to the starting end of the second roll of web material which is situated on a splicing table, where the web material of the first roll and the web material of the second roll are connected to each other such that during rolling off of the first and second roll of web material, inside the web material of the first roll (25) and near the nip between the first roll and a storage roll for this, said roller, which is pivotally hinged in a spring loaded arm, is provided such that the arm exerts a fit-up pressure on the web material of the first roll whereby the breaking or the termination of the web material of the first roll, swings the roller in a direction off the first and second roll, whereby an end portion of the web material of the first roll is carried and transported to the splicing table, the splicing table being provided between two stores for the first and second roll, the second store providing a unit for lifting and moving the second roll (16) of web material to the first store.

2. The device according to claim 1 wherein the stores for the first and second rolls each consist of two parallel support rolls separated from each other, such that in the first store, one of the support rolls is a feeding roll for pulling out the web material of the first roll to a consumer station and in the second store, one of the support rolls is a lifting roll for lifting the second roll (16) of web material out of the store.

3. The device according to claim 2, wherein the splicing table is included as a portion of a conveyor arranged between the two stores, the conveyor preferably constituted by a ramp with a slight inclination towards the first store.

4. The device according to claim 1, wherein the spring loaded arm is rotatable, the rotating center of which coincides with the rotating center of one of the support rolls of the first store.

5. The device according to claim 1, wherein rotation of the arm actuates a sensor for activation of a retainer apparatus, which is adapted for fixing the position of the first and second roll or the winding core against the store, thereby retaining the rotability of the first and second roll.

6. The device according to claim 4, wherein the roller further comprises concentrically pivoted wheels arranged at the roller and the arm of the roller, respectively, to space the roller from the first and second roll.

* * * * *